US005458409A

United States Patent [19]

Sheng

[11] Patent Number: 5,458,409

[45] Date of Patent: Oct. 17, 1995

[54] ALL-PLASTIC CONTAINER WITH PIVOTING DRAWERS

[75] Inventor: Tony L. Sheng, Livingston, N.J.

[73] Assignee: Kowtow, Inc., Kearny, N.J.

[21] Appl. No.: 907,831

[22] Filed: Jul. 2, 1992

[51] Int. Cl.[6] ..... E05B 65/46

[52] U.S. Cl. ..... 312/216; 312/221; 312/328; 403/375; 29/453; 29/434

[58] Field of Search ..... 312/215, 216, 312/221, 327, 328, 275, 276, 271, 248; 403/375; 29/453, 434

[56] References Cited

U.S. PATENT DOCUMENTS

| | | | |
|---|---|---|---|
| 154,244 | 8/1874 | Hacker | 312/327 |
| 2,535,688 | 12/1950 | Lowther | 312/328 |
| 2,658,727 | 11/1953 | Eck | 312/327 |
| 2,785,038 | 3/1957 | Elsden | 312/327 |
| 3,207,566 | 9/1965 | Grieco | 312/327 |
| 4,490,060 | 12/1984 | Mistyurik | 29/453 |
| 4,616,891 | 10/1986 | Jantzen | 312/216 |
| 4,892,367 | 1/1990 | Jantzen | 312/328 |
| 4,917,303 | 4/1990 | Maas | 29/453 |

*Primary Examiner*—Flemming Saether

[57] ABSTRACT

An all plastic container has a plurality of drawers which are pivotally secured within a frame. The drawers have pivot studs which are introduced into ramped grooves in the sides of the frame and which are retained within recesses in the sides when the container is fully assembled. Advantageously, the recesses are located behind the front surface of the container by approximately 40% of the depth of the frame.

7 Claims, 10 Drawing Sheets

ALL-PLASTIC CONTAINER WITH PIVOTING DRAWERS

BACKGROUND OF THE INVENTION

The present invention relates to storage containers and more particularly relates to portable plastic storage containers. In its most immediate sense, the present invention relates to portable plastic storage containers in which an upright frame contains drawers which pivot open and shut.

In a known container of this type, a vertical frame contains pivotable drawers which are linked together to open and close together. (This linkage is provided to make it possible to lock the drawers shut in an inexpensive manner; to lock all the drawers, it is only necessary to lock one.) The drawers are secured to the frame by axially aligned pivot pins which are driven into the drawers and which extend through, and rotate within, open pivot holes in the frame.

This known container has two major disadvantages. The first of these is that the container is relatively expensive. (This is a severe drawback since such products are sold in a highly price-sensitive market.) This expense comes about because the pins themselves are costly and assembly is labor-intensive, since each drawer must be individually secured within the frame using a pair of pins.

The second disadvantage is that the container can easily tip over when heavily loaded. This is because the pins are located relatively close to the front of the frame. As a result, when the loaded drawers are pivoted open, the center of gravity of the loaded container can be shifted forward of the front of the frame and the container can tip over.

It would be advantageous to provide a container of this type which would be less expensive to manufacture and less likely to tip over when loaded.

In accordance with the invention, the drawers are provided with integral axially aligned pivot shafts and the frame has mating recesses in which the pivot shafts are retained. Ramped grooves in the frame connect the recesses with the front of the frame, and the distance between the bottom surfaces of corresponding grooves decreases from a maximum at the front of the frame to a minimum immediately adjacent the recesses.

When the drawers are inserted into the frame, the pivot shafts are guided toward the recesses by the grooves but the drawers are slightly compressed and the frame is slightly expanded as the insertion process continues. Once the pivot shafts reach the recesses, the pivot shafts snap in place and the drawers and frame regain their undistorted shapes. In this way, the drawers are pivotally supported within the frame without the use of metal pins. Additionally, all the drawers can be simultaneously inserted into, and secured within, the frame. Thus, the cost of the metal pins is completely eliminated and the costs of assembly are substantially reduced.

In accordance with the preferred embodiment of the invention, the recesses are more than one third of the distance behind the front surface of the frame; advantageously, the distance between the front surface and the recesses is approximately 40% of the depth of the frame. When the drawers of the preferred embodiment are fully opened, it is quite unlikely that the center of gravity of the loaded container can move forward of the front of the frame. In this way, the container is less likely to tip over when the drawers are opened.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

Figure 2:
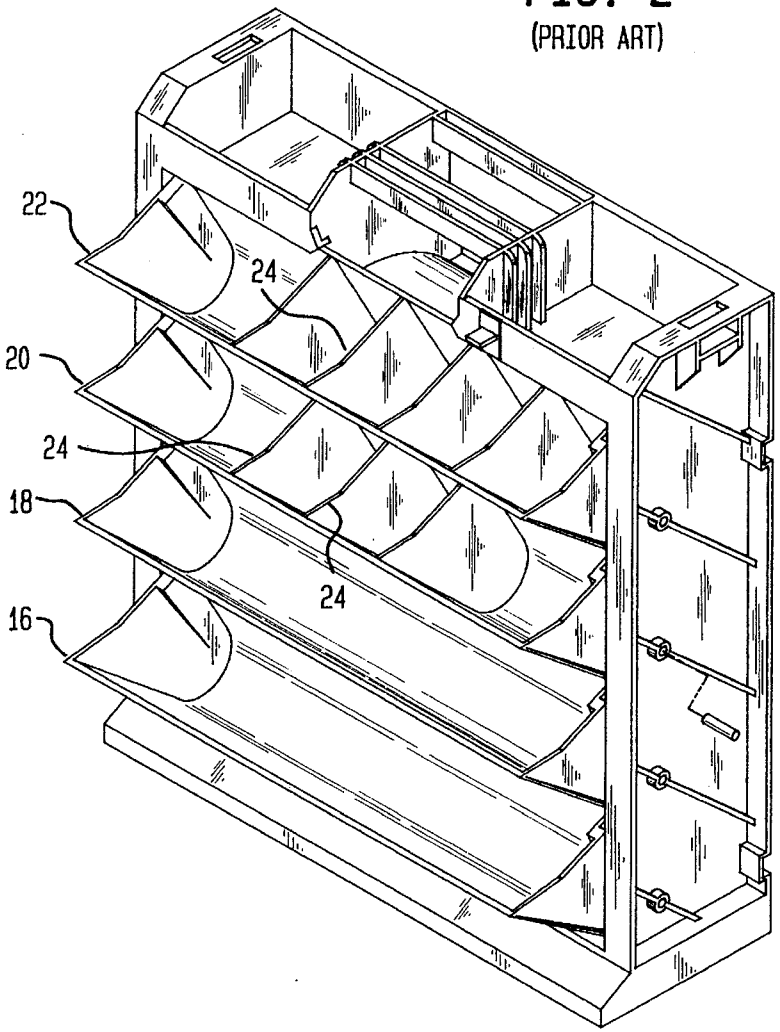
FIG. 2 (PRIOR ART)
FIGS. 1–4 show a known container.

In a known container manufactured by POSSO under the FLIPPER-BOX designation, a plastic frame 2 is a unitary plastic casting. The frame 2 has left and right sides 4 and 6 respectively, front and back surfaces 8 and 10 respectively, and a front extension 12 which will be discussed below. To reinforce the frame 2 and prevent it from deforming under load, ribs 14 are molded into the sides 4 and 6.

Four drawers 16, 18, 20 and 22 are mounted in the frame 2. The drawers 16, 18, 20, and 22 are similar, but the bottom drawer 16 is slightly deeper than the other three drawers 18, 20 and 22 and the top two drawers 20 and 22 contain non-removable dividers 24. (These dividers 24 prevent a user from loading a long heavy item, such as a wrench or bar, in the top two drawers 20 and 22. This would make it easier to tip the container over.)

The operation of the drawers 16, 18, 20 and 22 will now be described with reference to FIG. 2. Each of the drawers is pivotable about an axis defined by pivot pins which secure the drawer to the frame 2. There are eight such pins, and since the structure of the container is identical at each of the corresponding eight locations, only the structure adjacent the right pin 20R for drawer 20 will be described.

The proximal end of the pivot pin 20R is tightly press-fit into a bushing 20B on the right end of the drawer 20 and the distal end of the pivot pin 20R extends into a pivot hole 20H in the frame 2. The pivot hole 20H is located in a bearing 20BE in the frame 2. To assemble the drawers 16, 18, 20 and 22 in the frame 2, the drawers must be positioned within the frame 2 and the eight pivot pins (such as pivot pin 20R) must be inserted into the pivot holes (such as pivot hole 20H) and forced into the bushings (such as bushing 20B) of the drawers (such as drawer 20). This is both expensive (because of the cost of the pivot pins such as 20R) and labor intensive because of the work needed to align the bushings (such as bushing 20B) with the bearings (such as bearing 20BE) and to drive the pivot pins (such as pivot pin 20R) into the drawers (such as drawer 20).

Figure 1:
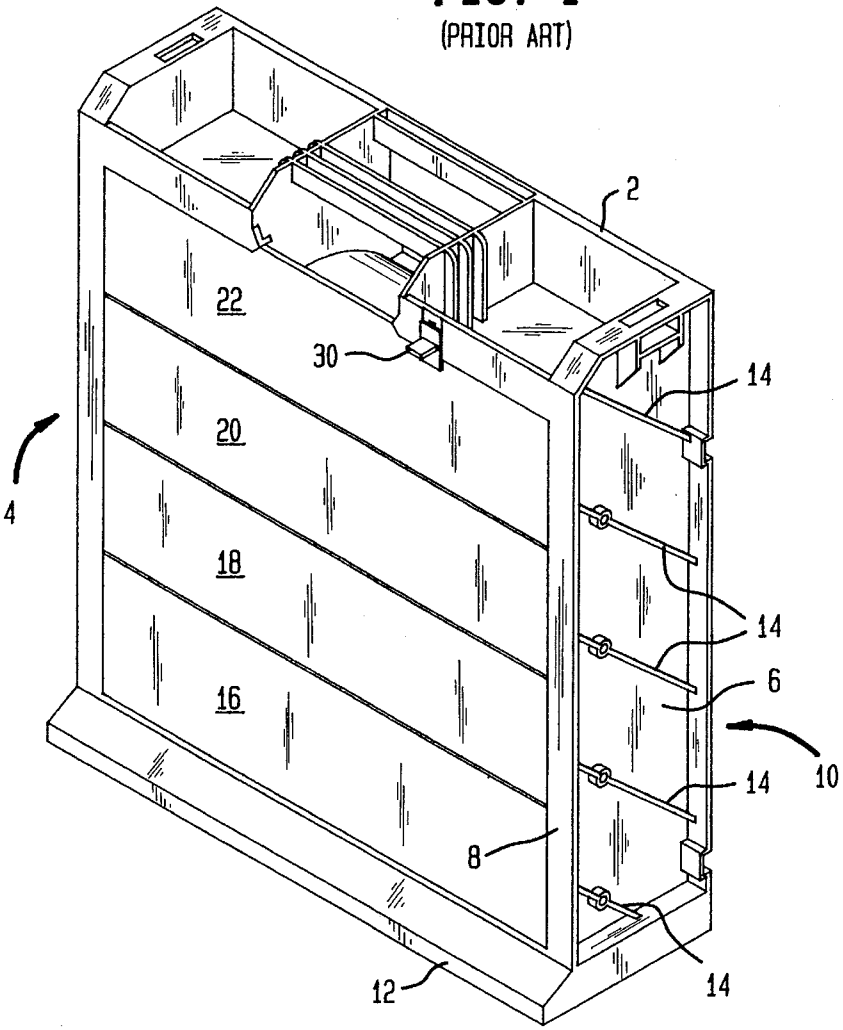
FIG. 1 (PRIOR ART)
Figure 3:
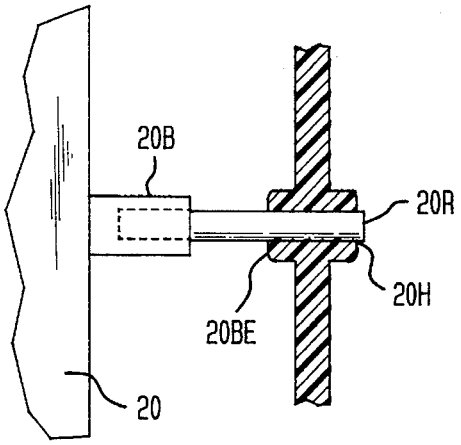
FIG. 3 (PRIOR ART)

To hold the drawers shut in this known container in an economical fashion, the drawers 16, 18, 20 and 22 are linked together by two like link rods 28. A slide latch 30 (see FIG. 1), located on the front surface 8, slides over the top surface of the drawer 22 and prevents the drawer 22 from pivoting. This permits all the drawers to be locked shut by locking only one. The link rods 28 are adjacent the left and right sides 4 and 6 respectively of the frame 2. The operation of the link rods 26 and 28 is identical, only the operation of the link rods 28 will be described in connection with FIG. 4.

Each of the drawers 16, 18, 20 and 22 has a link stud on each side; in the case of the right side of drawer 20, the link stud is 20S. Each of the link studs (such as 20S) engages one of the link rods (such as link rod 28) through a link stud opening (such as link stud opening 280). It can therefore be seen that as the drawers pivot, they move together since they are hinged together by the link rods 26 and 28.

Each of the link arms 26 and 28 has two detent arms; for the link arm 28, these are the upper detent arm 28U and the lower detent arm 28L. On the inside of the right side 6 of the frame 2, two stop ridges 6U and 6L are located; the same structure is located on the inside of the left side 4 of the frame 2 but this works in the same way and will not be separately described. When the drawers are opening, the link arm 28 moves up and towards the back 10 of the frame 2 until just before the drawers are fully open. At this point, the link arm 28 continues to move up, but moves forward slightly and the distal end of the lower detent arm 28L passes over the stop ridge 6L. This provides a tactile feedback to the user, letting him know that the drawers are about to be completely open, and also provides a moderate locking action to hold the drawers fully open. The upper detent arm 28U and the stop ridge 6U perform a similar function at the other extreme of drawer motion; just before the drawers are fully closed, the distal end of the upper detent arm 28U passes over the stop ridge 6U to let the user know that the drawers are almost completely closed and to provide a moderate locking action to hold them shut.

Figure 4:
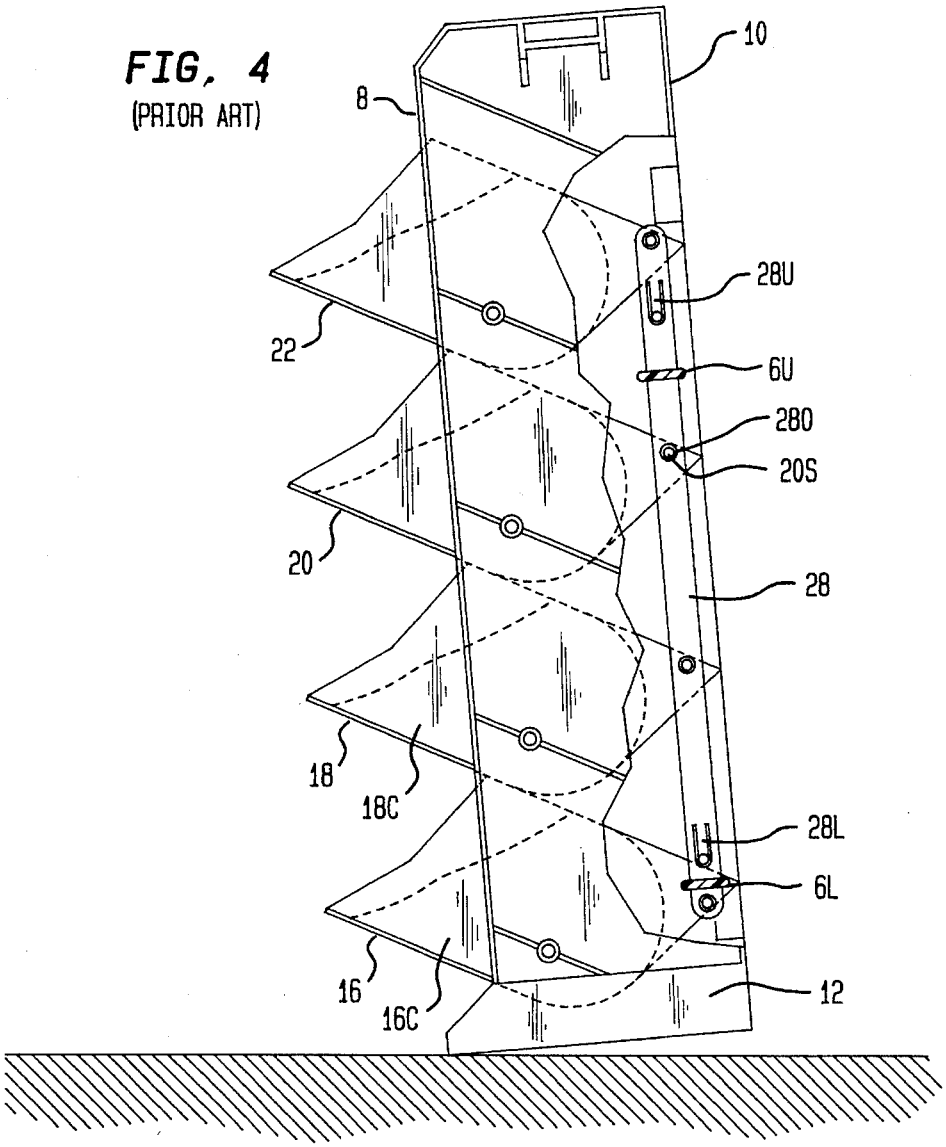
FIG. 4 (PRIOR ART)

The dimensions of this known container are such that it can easily become unstable. Let it be assumed that the drawers are loaded and that the bottom drawers 16 and 18 contain relatively heavy tools such as wrenches or prybars. This is illustrated in FIG. 4, which shows the centers of gravity 16C and 18C for these two drawers. As the drawers all open up, the centers of gravity 16C and 18C move forwardly until they move forward of the front surface 8. At this point, the container is liable to tip over. To reduce the likelihood that this will happen, the front extension 12 is provided at the bottom of the frame 2. While the front extension 12 does perform this function, this solution is not entirely satisfactory because it cannot compensate for very heavy loads in the drawers unless it is made quite large. This would be expensive (because of the amount of material required) and awkward.

The inherent instability of this known container comes about because of the consequences of a decision to provide four relatively narrow drawers 16, 18, 20 and 22. Because the drawers are relatively narrow, they must also be shallow, in order to provide convenient access to their contents. With these dimensional constraints, the pivot pins must be located close to the front surface 8; in this known container, the distance between the pivot pins and the front surface 8 is only 33% of the depth of the frame, i.e. 33% of the distance between the front surface 8 and the back surface 10. As a result, the centers of gravity of the fully-loaded drawers can easily move in front of the front surface 8 when the drawers are opened.

Figure 5:
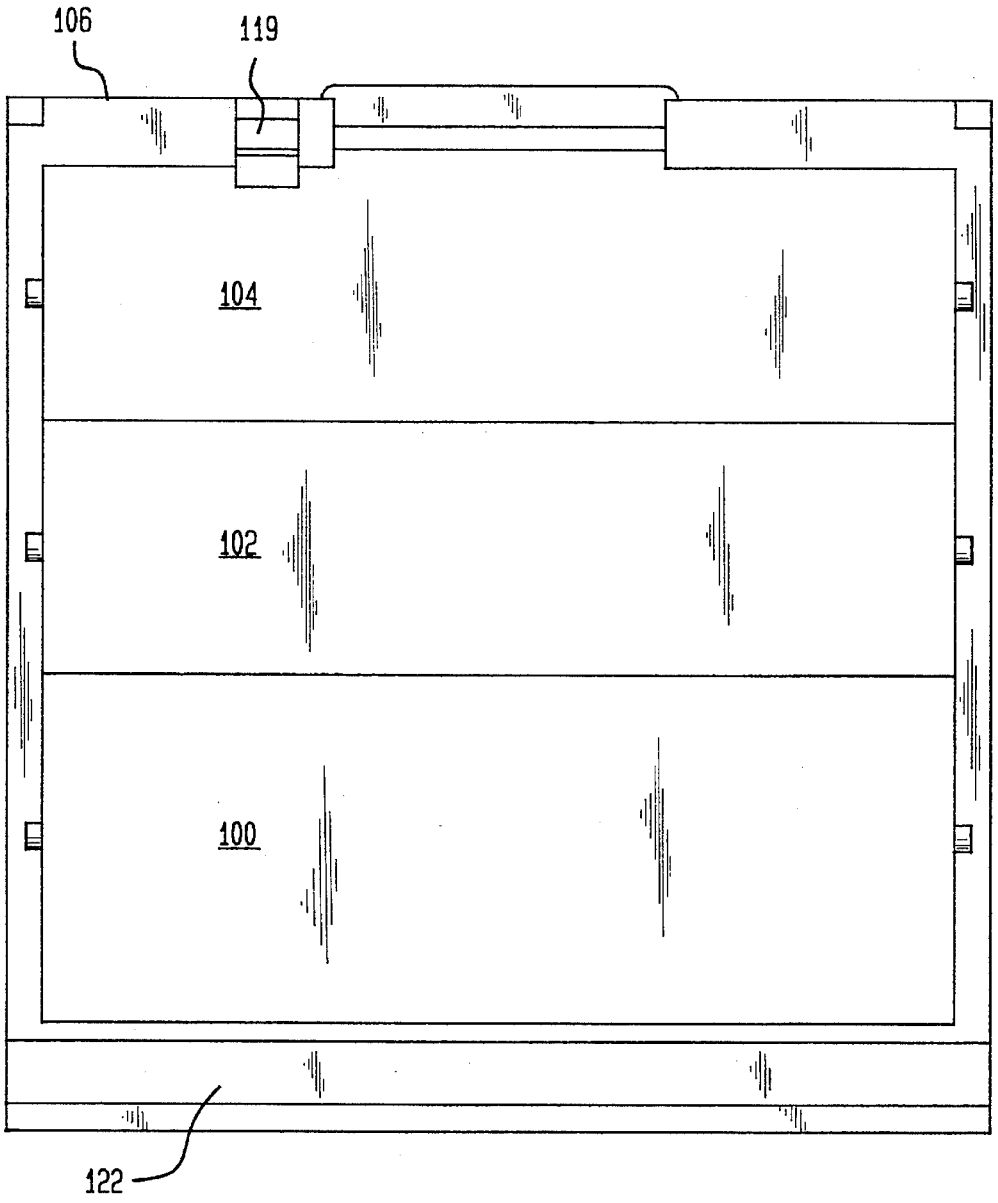
FIG. 5 shows the front view of a preferred embodiment in accordance with the present invention.
Figure 6:
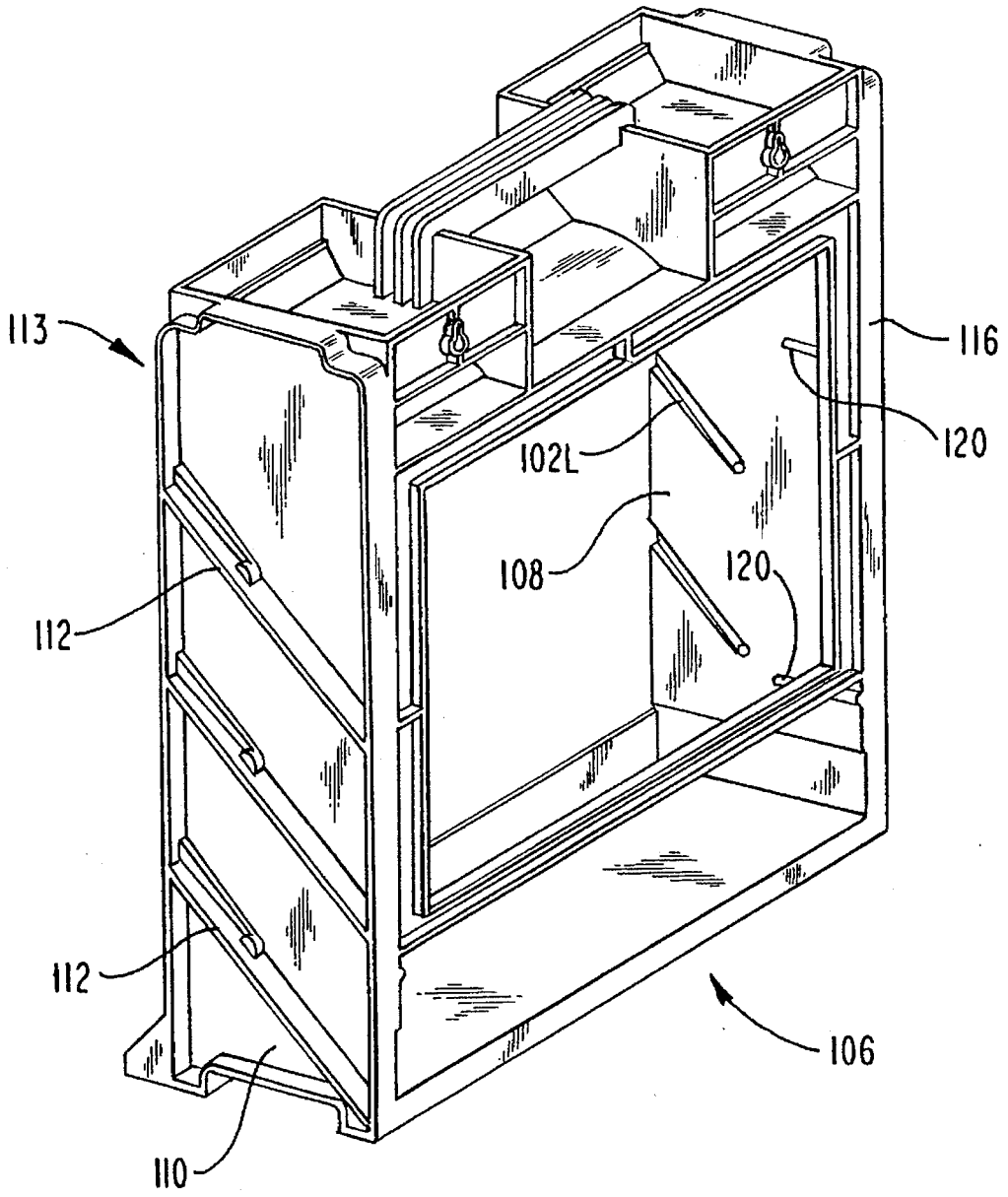
FIGS. 6–10 show various views and construction details of the preferred embodiment.
Figure 7:
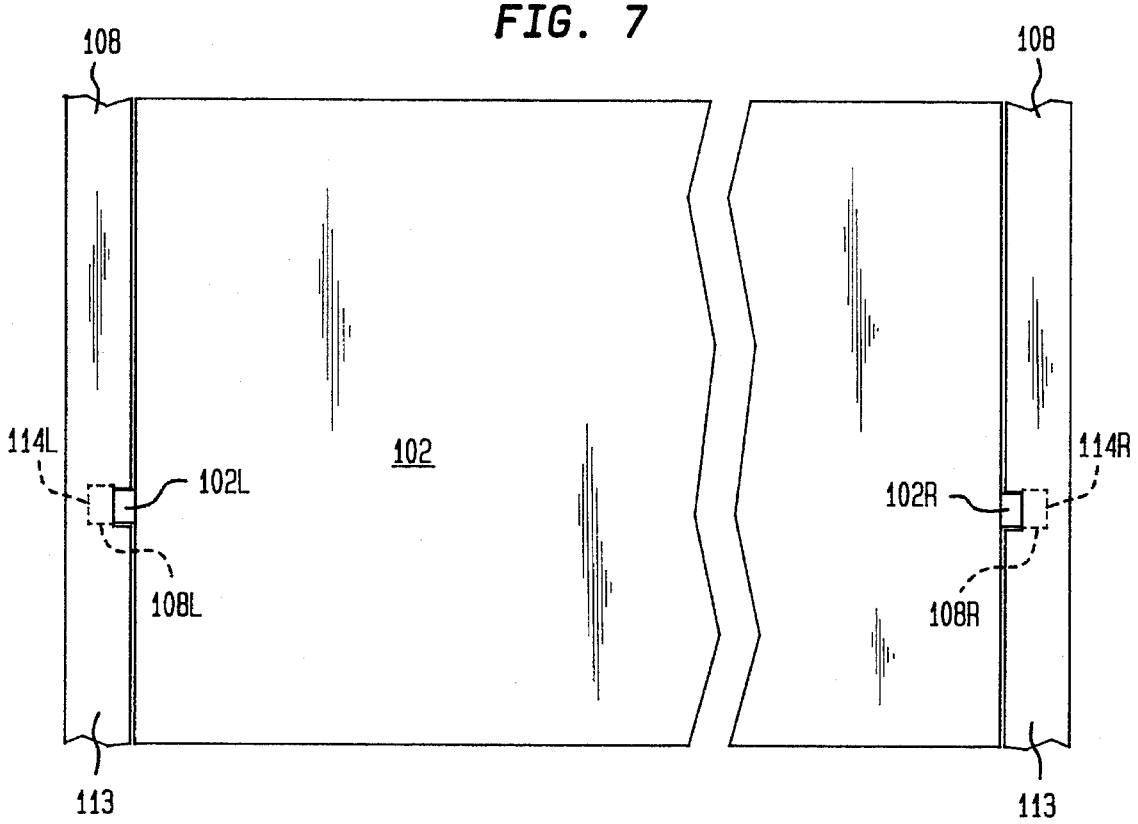
Figure 8:
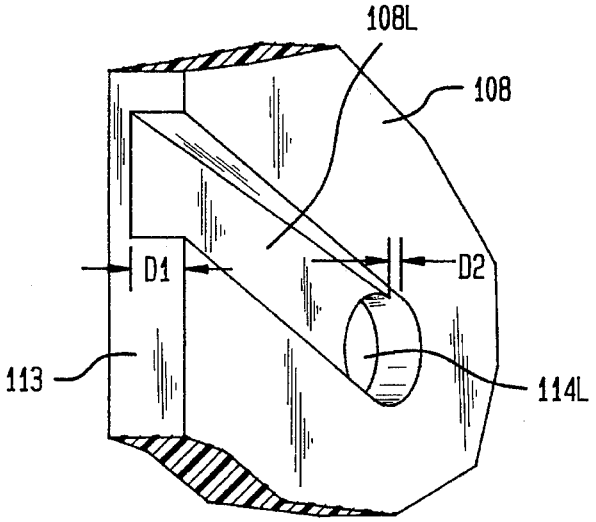
Figure 9B:
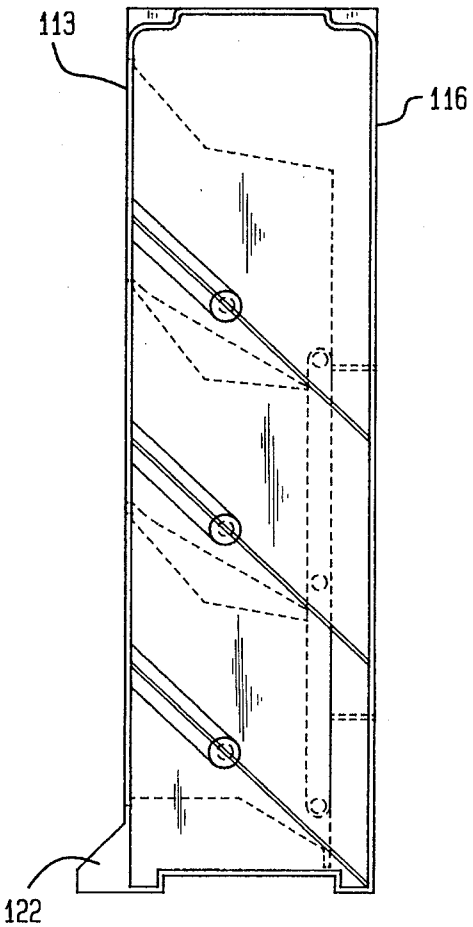
Figure 9A:
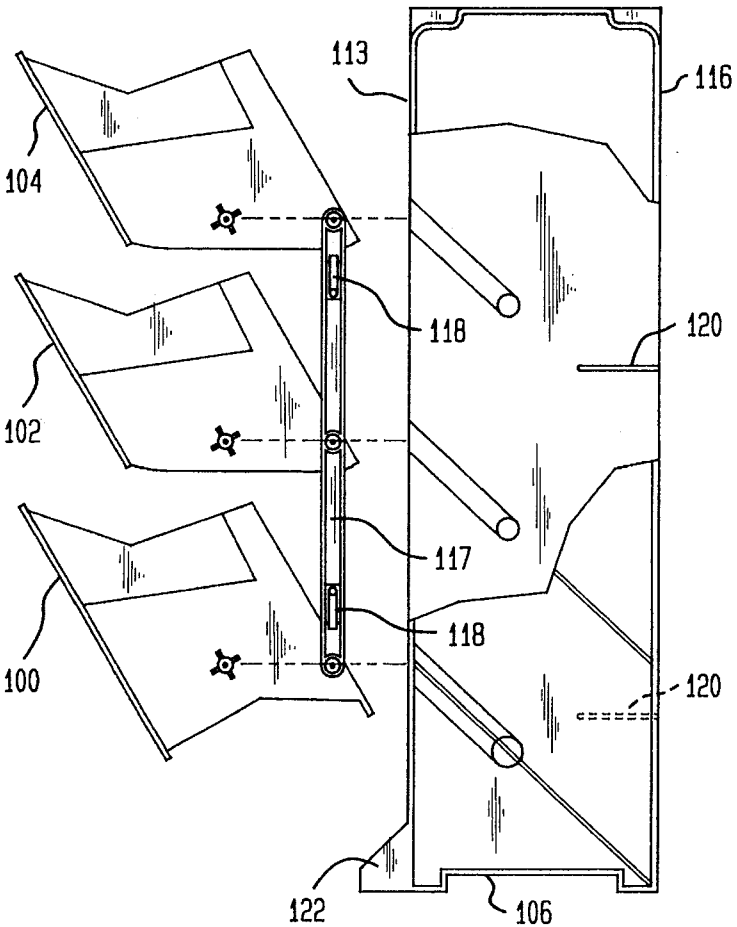

A preferred embodiment of the invention will now be described in connection with FIGS. 5–7. This preferred embodiment has three drawers 100, 102 and 104 which are pivotally secured within a frame 106. (The number of drawers is not part of the invention; there may be as few as two or as many as desired.)

The drawers 100, 102 and 104 are similar, but not identical. The bottom drawer 100 is somewhat larger than the other two drawers 102 and 104, and the bottom drawer 100 has no central divider 108 as does each of the drawers 102 and 104. (This is to prevent large and heavy objects from being loaded into the drawers 102 and 104 and thereby overbalancing the container.) The manner in which the drawers 100, 102 and 104 are secured within the frame 106 will be described with specific reference to drawer 102, since the other drawers 100 and 104 are simultaneously secured within the frame 106 in the same way, using a tool 302 which is described in more detail below.

The drawer 102 (see FIG. 7) pivots about an axis defined by two pivot studs 102L and 102R which are integral with the drawer 102. The frame 106 has a left side 108 and a right side 110, both of which are reinforced by ribs 112. Within the left side 108 is a downwardly and rearwardly extending groove 108L and within the right side 110 is a corresponding downwardly and rearwardly extending groove 110R. The grooves 108L and 110R have widths which are slightly larger than the diameters of the pivot studs 102L and 102R, and are aligned with the ribs 112 for rigidity.

The grooves 108L and 110R are not of constant depth; they are ramped to have a maximum depth D1 at the front surface 113 of the frame 106 and a progressively decreasing depth (to minimum depth D2) as they extend downwardly and rearwardly towards recesses 114L and 114R in the left side and right side 108 and 110 respectively. The recesses 114L and 114R are slightly larger and deeper than are the pivot studs 102L and 102R.

When a container in accordance with the preferred embodiment of the invention is assembled, the pivot studs 102L and 102R are introduced into the grooves 108L and 110R respectively and the drawer 102 is forced toward the back surface 116 of the frame 106. As the insertion process continues, the drawer 102 is compressed slightly and the sides 108 and 110 are bowed slightly outwardly, because the depth of the grooves 108L and 110R decreases from the front to the back of the frame 106. Finally, the pivot stud 102L enters the recess 114L and the pivot stud 102R enters the recess 114R. The drawer 102 then expands and the sides 108 and 110 snap back to their original positions. In this way the drawer 102 is rotatably secured within the frame 106.

Figure 11:
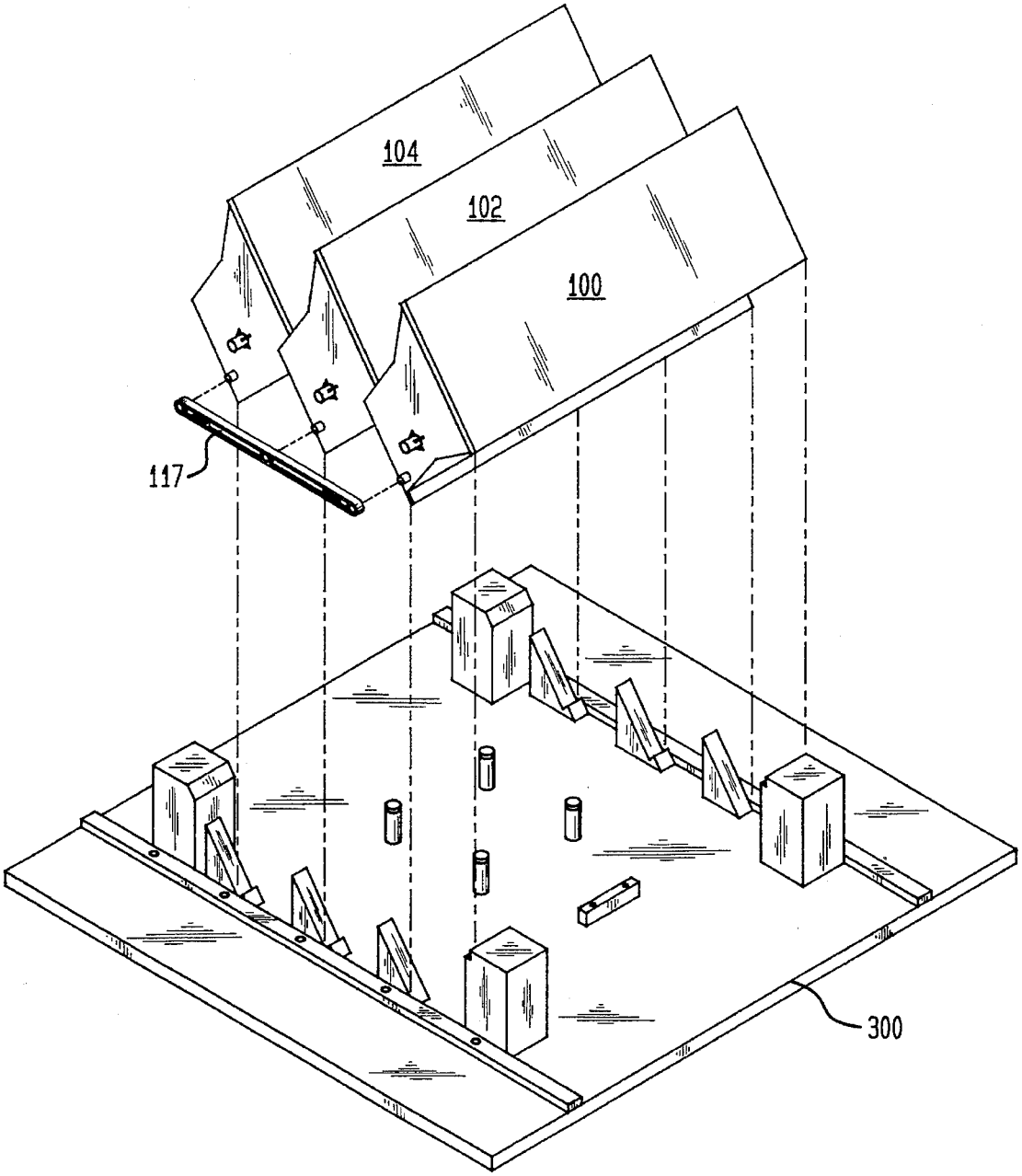
FIGS. 11–13 show how a container in accordance with the preferred embodiment is advantageously assembled.
Figure 12:
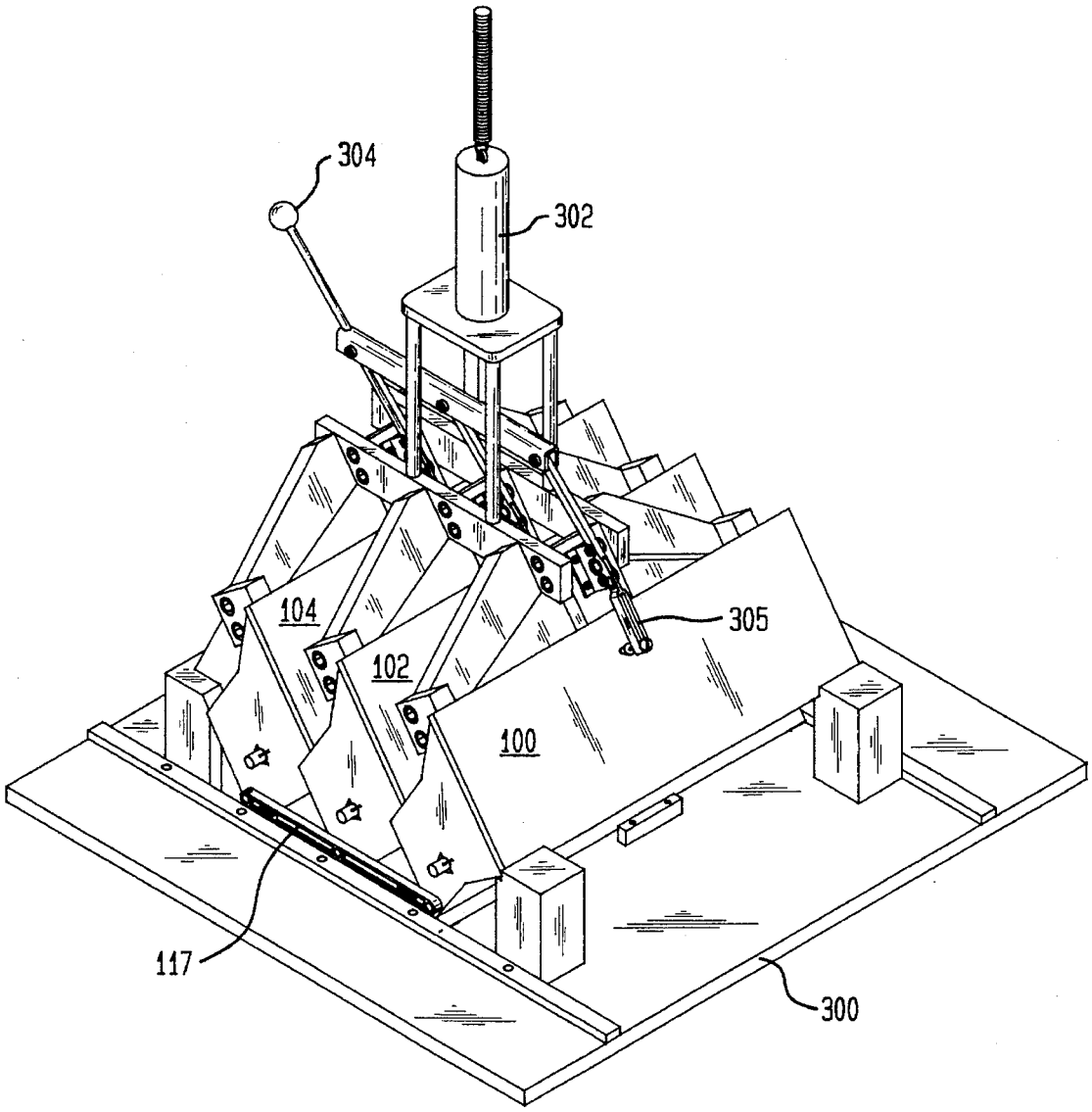
Figure 13:
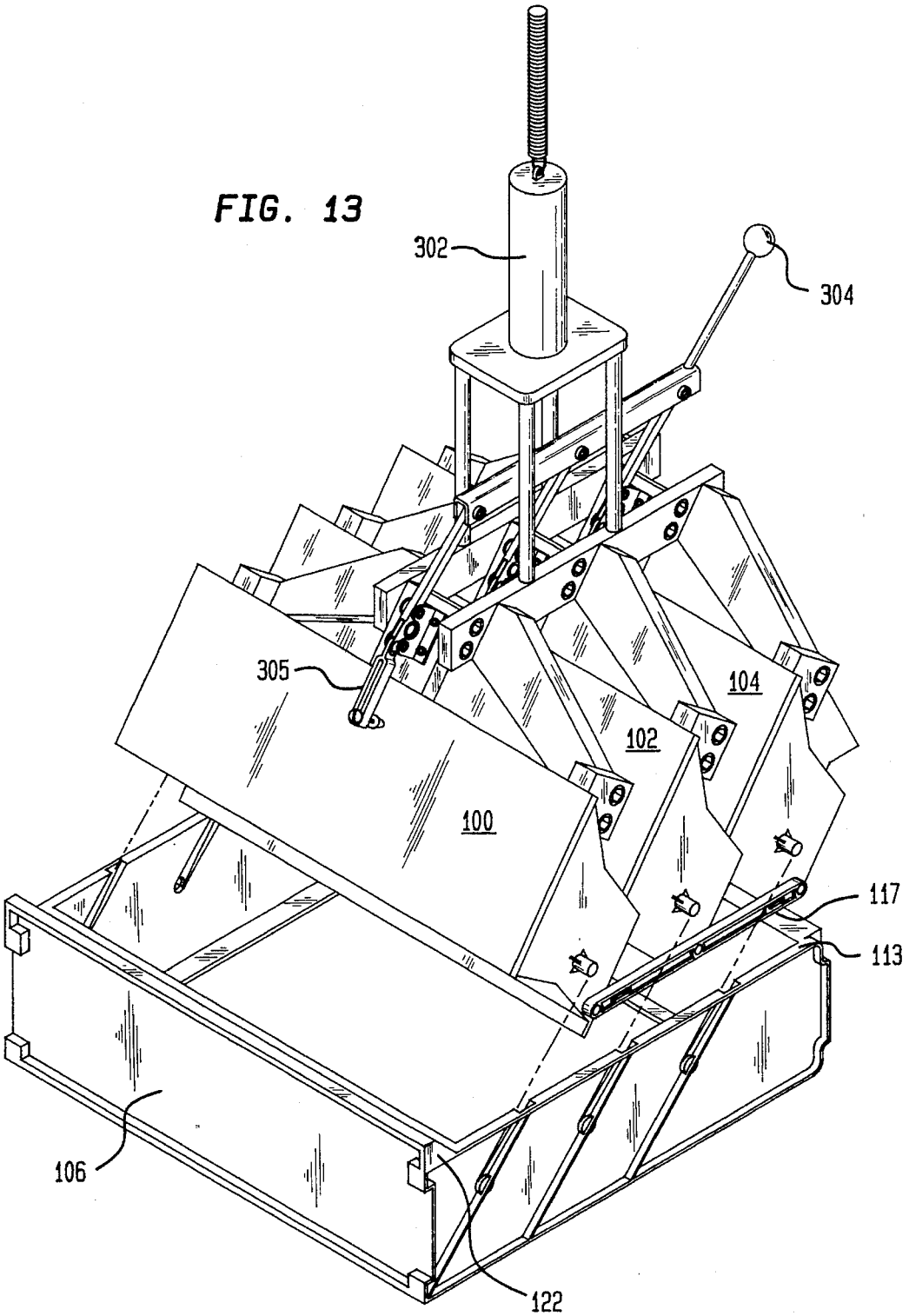

In the preferred embodiment, the drawers 100, 102 and 104 are all linked together by two identical link arms 117 and the link arms 117 have upper and lower detent arms 118 which engage stop ridges 120 in the sides 108 and 110. The functioning of these elements is as described above in connection with a known container and will not be repeated here. However, it is important to note that when the drawers 100, 102 and 104 are to be inserted into the frame 106, they are preassembled (together with the link arms 117) in a slightly (about 30 degrees) open position in an assembly jig 300 (see FIG. 11). A tool 302 (see FIG. 12) is then lowered onto the assembled drawers 100, 102 and 104 and locked onto the drawers by operation of a lever 304, which causes locking arms 305 to grasp the drawers 100, 102 and 104. The drawers 100, 102 and 104 with attached link arms 117 are then lifted off the assembly jig 300 and then forced, using the tool 302, into the frame 106 together as an assembled unit. After the drawers 100, 102 and 104 with attached link arms 117 have been so installed within the frame 106, the tool 302 is unlocked by operation of the lever 304 (which unlocks the locking arms 305 from the drawers 100, 102 and 104) and detached from the assembled container. The drawers 100, 102 and 104 are held in an open position in the assembly jig 300 and tool 302 because if they are in a closed position, the back of the top drawer 104 will strike the top of the front surface 113 of the frame 106 and the drawers 100, 102 and 104 will not fit into the frame 106. Once the drawers 100, 102 and 104 have been fully inserted into the frame 106, they may be locked shut by moving slide 119 downwardly over the top edge of the front of the top drawer 104.

It will now be apparent that in accordance with the invention, it is possible to preassemble the drawers 100, 102 and 104 with the link arms 117 and then to introduce the entire preassembly into the frame 106 at one time. This not only eliminates the costs of the metal pins which are used in known devices, but also substantially reduces the time (and therefore the cost) of assembly.

Figure 10:
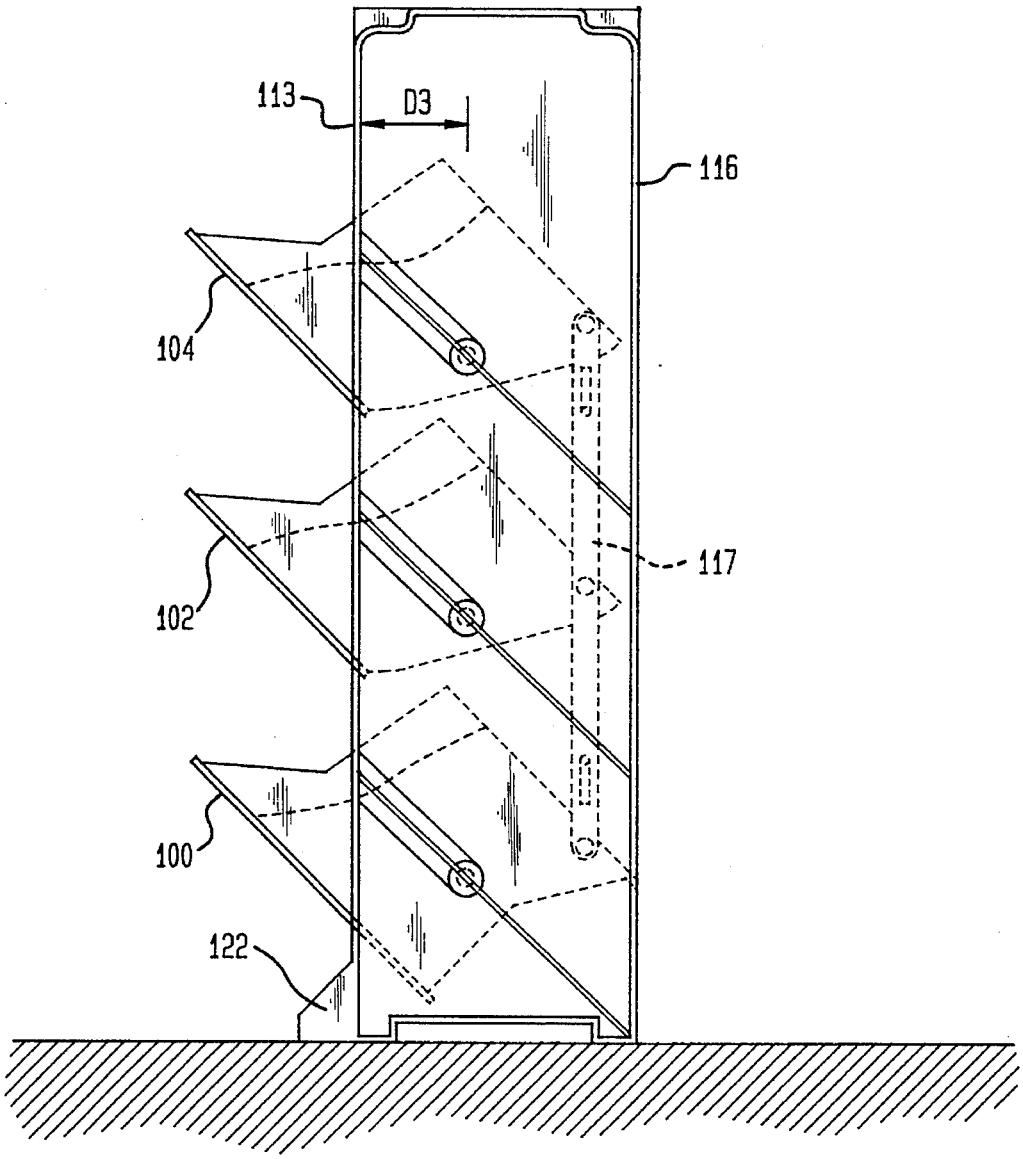

While the frame 106 also has a front extension 122 which adds to the stability of the preferred embodiment, the main improvement in stability comes from positioning the pivot axes of the drawers 100, 102 and 104 further rearwardly (see FIG. 10). The distance D3 between the front surface 113 and the recesses 114L and 114R is greater than 33% of the depth of the frame 106 as measured between the front surface 113 and the rear surface 116; advantageously, and in the preferred embodiment, this distance is slightly more than 40% of the depth of the frame. While it is not impossible to overbalance the container by misloading the drawers, it is substantially more difficult to do so than in the known container described above.

Although a preferred embodiment has been described above, the scope of the invention is limited only by the following claims:

I claim:

1. An all-plastic container comprising:

a plastic frame having vertically extending sides in which are located a plurality of pairs of downwardly and rearwardly extending grooves which terminate in corresponding pairs of recesses located within the sides, said grooves being ramped to have maximum depths at a front surface of the frame and minimum depths immediately adjacent the recesses; and a like plurality of parallel drawers, each drawer being of a unitary piece of plastic and having a pair of pivot studs which engages a corresponding pair of said recesses in the frame.

2. The container of claim 1, wherein all the drawers are linked together.

3. The container of claim 2, further including means for preventing one of the drawers from pivoting and thereby locking all of the drawers in position.

4. The container of claim 3, wherein said preventing means comprises a slide mounted on the front surface of the frame and engaging a topmost one of the drawers.

5. The container of claim 1, wherein each of the sides has a plurality of downwardly and rearwardly extending reinforcing ribs, each of the ribs being aligned with a corresponding one of the grooves.

6. The container of claim 1, wherein the distance between the front surface of the frame and the recesses exceeds 33% of the depth of the frame.

7. The container of claim 6, wherein said distance is approximately 40% of the depth of the frame.

* * * * *